US007123753B2

(12) United States Patent
Takahashi et al.

(10) Patent No.: US 7,123,753 B2
(45) Date of Patent: Oct. 17, 2006

(54) MASCARA SELECTING METHOD, MASCARA SELECTING SYSTEM, AND MASCARA COUNSELING TOOL

(75) Inventors: Shun Takahashi, Yokohama (JP); Fumie Morohoshi, Yokohama (JP); Hideki Takahashi, Yokohama (JP)

(73) Assignee: Shiseido Company, Ltd., Tokyo (JP)

( * ) Notice: Subject to any disclaimer, the term of this patent is extended or adjusted under 35 U.S.C. 154(b) by 737 days.

(21) Appl. No.: 10/432,760

(22) PCT Filed: Dec. 25, 2001

(86) PCT No.: PCT/JP01/11367

§ 371 (c)(1),
(2), (4) Date: May 28, 2003

(87) PCT Pub. No.: WO02/051285

PCT Pub. Date: Jul. 4, 2002

(65) Prior Publication Data

US 2004/0050400 A1 Mar. 18, 2004

(30) Foreign Application Priority Data

Dec. 26, 2000 (JP) ..... 2000-395823

(51) Int. Cl.
*G06K 9/00* (2006.01)

(52) U.S. Cl. ..... 382/117; 382/100; 351/206

(58) Field of Classification Search ..... 382/100, 382/115, 117, 118; 351/206
See application file for complete search history.

(56) References Cited

U.S. PATENT DOCUMENTS

| | | | | |
|---|---|---|---|---|
| 3,557,653 | A | 1/1971 | Kim | |
| 4,434,467 | A | 2/1984 | Scott | |
| 4,823,285 | A | 4/1989 | Blancato | |
| 5,495,338 | A | 2/1996 | Gouriou et al. | |
| 6,944,327 | B1 * | 9/2005 | Soatto | 382/154 |

FOREIGN PATENT DOCUMENTS

| | | |
|---|---|---|
| EP | 0290327 | 11/1988 |
| JP | 1-237167 | 11/1989 |
| JP | 8-202754 | 8/1996 |
| JP | 9-204138 | 8/1997 |
| JP | 9-221412 | 8/1997 |
| JP | 9221412 | 8/1997 |
| JP | 1075823 | 3/1998 |

(Continued)

OTHER PUBLICATIONS

Knox, et al, An Accurate, Non-Invasive New Method of Assessing Volumizing, Thickening and Lengthening Efficacy of Mascara Products, Clinical Research Laboratories.*

(Continued)

*Primary Examiner*—Bhavesh M. Mehta
*Assistant Examiner*—John B. Strege
(74) *Attorney, Agent, or Firm*—Ladas and Parry LLP

(57) ABSTRACT

A salesperson counseling a customer at a shop can adequately and quickly select a mascara that gives satisfaction to the customer. A method for selecting a mascara includes a first measurement step of measuring an eyelash state of a customer, and a selection step of selecting a mascara based on the result of the measurement made in the first measurement step. Further, between the first measurement step and the selection step, an ascertaining step of ascertaining a desire of the customer for eyelashes is provided, and in the selection step, a mascara is selected based on the measurement result obtained from the first measurement step and the desire of the customer obtained from the ascertaining step.

5 Claims, 11 Drawing Sheets

FOREIGN PATENT DOCUMENTS

| | | |
|---|---|---|
| JP | 11-56469 | 3/1999 |
| JP | 1156469 | 3/1999 |
| JP | 2000-4939 | 1/2000 |
| JP | 20004939 | 1/2000 |
| JP | 3069967 | 7/2000 |

OTHER PUBLICATIONS

Patent Abstracts of Japan of JP 8-202754 dated Aug. 9, 1996.
Patent Abstracts of Japan of JP 9-221412 dated Aug. 26, 1997.
Patent Abstracts of Japan of JP 2000-4939 dated Jan. 11, 2000.
Patent Abstracts of Japan of JP 1-273167 dated Nov. 1, 1989.
Patent Abstracts of Japan of JP 9-204138 dated Aug. 5, 1997.
Patent Abstracts of Japan of JP 11-56469 dated Mar. 2, 1999.
JP 9-221412 (Pola Chemical Industries Inc.) Aug. 26, 1997 p. 2, col. 2, Lines 33 to 39.
JP 10-75823, (Shiseido Co., Ltd.), Mar. 24, 1998 Full Text; All Drawings.
JP 11-56469, (Shiseido Co., Ltd.), Mar. 2, 1999 p. 2, col. 2, Lines 33 to 40; p. 6, col. 9, Lines 9 to 32.
JP 2000-4939, (Shiseido Co., Ltd.), Jan. 11, 2000 Full Text; All Drawings.

* cited by examiner

FIG.7

| CONDITION | ORIGINAL EYELASH MEASUREMENT RESULT | CLASSIFICATION |
|---|---|---|
| ENTIRE AREA | BELOW AREA S<br>ABOVE AREA S | THIN<br>THICK |
| NUMBER OF EYELASHES | BELOW NUMBER N<br>ABOVE NUMBER N | FEW<br>MANY |

FIG.8

| CLASSIFICATION (OF ORIGINAL EYELASH MEASUREMENT RESULT) | MASCARA | MASCARA-APPLIED EYELASH STATE |
|---|---|---|
| THIN | MASCARA A<br>MASCARA B<br>MASCARA C<br>↓ | NATURAL<br>VOLUME<br>TONED DOWN<br>↓ |
| THICK | MASCARA A<br>MASCARA B<br>MASCARA C<br>↓ | SHAPE<br>ACTIVE<br>HEAVY<br>↓ |
| MANY | MASCARA A<br>MASCARA B<br>MASCARA C<br>↓ | REFINED<br>BRIGHT<br>CUTE<br>↓ |

FIG.11
(A)
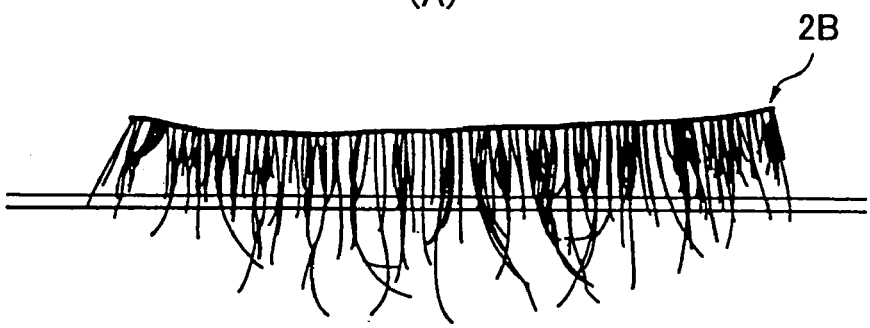
(B)
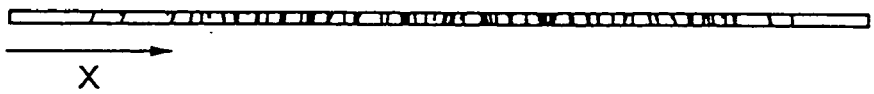

MASCARA SELECTING METHOD, MASCARA SELECTING SYSTEM, AND MASCARA COUNSELING TOOL

FIELD OF THE INVENTION

The present invention relates generally to a mascara selecting method, a mascara selecting system, and a mascara counseling tool, and particularly, to a mascara selecting method, a mascara selecting system, and a mascara counseling tool, suitably for employment by a salesperson in selecting a mascara while giving counsel to a customer at a shop.

BACKGROUND OF THE INVENTION

In purchasing a mascara, a customer may, for example, receive counseling from a salesperson at a shop in deciding which mascara to purchase (the so-called face-to-face selection). In this case, the salesperson makes inquires into an eyelash state the customer wishes to realize, and selects a suitable mascara in accordance with the desire of the customer.

It is noted that usage of a mascara is greatly influenced by the original state of eyelashes (e.g., thick lashes, thin lashes, long lashes, short lashes, etc.). Thus, the salesperson may not be able to accurately select a mascara that brings satisfaction to the customer if the salesperson cannot accurately determine the original eyelash state of the customer. It is particularly noted that prioritizing the preference of the customer in selecting a mascara does not necessarily lead to an effective selection of a mascara that can bring satisfaction to the customer.

However, the act of examining the eyelash state of a customer has not conventionally been practiced, and thus, selection of a mascara with due consideration for the eyelash state of the customer has not been performed. Therefore, an accurate selection of a mascara could not be performed and it has not always been possible to successfully select a mascara that can bring satisfaction to the customer.

Also, in selecting a mascara for a customer based on the original eyelash state of the customer and the preference of the customer, it may be difficult for the salesperson to memorize the characteristic features of all of the mascaras. Further, although a manual indicating the characteristic features of the mascaras exists, selecting a mascara by referring to the manual may be troublesome and the selection cannot be performed swiftly.

SUMMARY OF THE INVENTION

The present invention has been developed in response to the above described problems of the related art and its object is to provide a mascara selecting method, a mascara selecting system, and a mascara counseling tool that can realize an accurate and quick selection of a mascara that will bring satisfaction to a customer.

To this end, a mascara selecting method according to the present invention includes:

a first measurement step of measuring an eyelash state of a customer; and a selection step of selecting a mascara based on a measurement results obtained from the first measurement step.

In the above invention, a suitable mascara for each eyelash state (original eyelash state) can be estimated and determined beforehand in selecting a mascara in accordance with the above described steps. Thus, a mascara that is suitable for the eyelash state of the customer and is also capable of realizing an eyelash state that can satisfy to the customer is selected.

Also, in the mascara selecting method according to the present invention, an ascertaining step of ascertaining a desire of the customer for eyelashes may be performed in between the first measurement step and the selection step, and in the selection step, a mascara may be selected based on the measurement results obtained from the first measurement step and the desire of the customer obtained from the ascertaining step.

Accordingly, a mascara that is suitable for the eyelash state of the customer and also capable of realizing an eyelash state desired by the customer can be selected.

Also, in the first measurement step of the above mascara selecting method, the eyelash state of a customer may be measured using a measuring apparatus.

Accordingly, in measuring the eyelash state of a customer, the measurement result will be free from subjective influences and an objective measurement of the eyelash state of the customer can be determined.

Also, the above mascara selecting method may further include a second measurement step of measuring an eyelash state of a customer wearing the mascara selected in the selection step using a measurement apparatus.

In the above invention, the eyelash state of the customer is measured after the selected mascara is actually applied to the eyelashes of the customer. Thus, a mascara that is suitable for the eyelash state of the customer and also capable of realizing an eyelash state that can satisfy the customer is selected with more accuracy.

Also, in measuring the eyelash state of a customer in the first measurement step and the second measurement step of the above mascara selecting method, an image of the eyelashes of the customer may be obtained using an imaging apparatus and the eyelash state may be measured based on the image obtained by the imaging device.

According to the above invention, the eyelash state is measured based on the image of the eyelashes obtained from the imaging device. Thus, the eyelash state can be measured quantitatively. Thereby, the eyelash state of the customer can be determined easily, and a mascara that is suitable for the eyelash state of the customer and also capable of realizing an eyelash state that satisfies the customer can be accurately selected.

Also, a mascara selecting system according to the present invention for selecting a mascara that can realize an eyelash state desired by a customer includes:

an imaging device configured to image both eyelashes with the mascara applied and eyelashes without the mascara applied;

measuring means for quantitatively measuring the eyelash state of the imaged eyelashes;

a database that stores mascara information indicating a relationship between the eyelash state before application of the mascara and the eyelash state after the application of the mascara for each mascara;

an input apparatus for inputting an eyelash state desired by the customer;

searching means for searching a mascara that meets the desire of the customer from the database based on the eyelash state of the customer before application of the mascara obtained by the measuring means and the eyelash state desired by the customer input from the input apparatus; and display means for displaying at least the image of the eyelashes of the customer imaged by the imaging apparatus and the mascara searched out by the searching means.

According to the above invention, the eyelash state is quantitatively measured based on the image of eyelashes obtained by the imaging apparatus. Thereby, upon selecting a mascara, the eyelash state of the customer can be accurately evaluated, and a mascara that is suitable for the eyelash state of the customer and also capable of realizing an eyelash state that meets the desire of the customer and brings satisfaction to the customer can be accurately selected.

Also, since mascara information for each mascara indicating the relationship between the eyelash state before application of the mascara and the eyelash state after the application of the mascara is stored in the database, a mascara that meets the desire of the customer can be easily and quickly selected based on the eyelash state of the customer before application of the mascara obtained by the measuring means and the eyelash state desired by the customer input from the input apparatus upon selecting a mascara for a customer with the searching means.

Further, since the display means displays at least the image of the eyelashes of the customer obtained by the imaging apparatus and the mascara searched out by the searching means, the customer is able to select a mascara by referring to the display means.

Also, the above mascara selecting system further includes a classifying means for classifying the eyelash state of the customer before application of mascara measured by the measuring means according to a predetermined system, and the mascara information stored in the database is arranged to include information on a relationship between a mascara and the eyelash state obtained from applying this mascara for each classification result.

According to the above invention, the eyelash state of a customer before application of a mascara is classified by the classifying means according to a predetermined system and the database stores mascara information indicating the relationship between a mascara and the eyelash state obtained from applying this mascara for each classification result. Thus, a process of selecting a mascara that meets the desire of the customer can be easily and quickly realized by the searching means.

Also, a mascara counseling tool according to an embodiment of the present invention maps out and displays a plurality of the original eyelash states and a plurality of corresponding mascara-applied eyelash states each with a predetermined mascara for each of the original eyelash states.

According to the above invention, the customer can use the mascara counseling tool to select a mascara by determining a preferred eyelash state from a plurality of the displayed eyelash state patterns that correspond to the original eyelash state of the customer. That is, each of the eyelash state patterns show the probable result obtained from applying a predetermined mascara on the eyelashes of the customer. Thus, a mascara suitable for the eyelash state of the customer and also capable of realizing an eyelash state that satisfies the customer can be selected with very simple procedures.

BRIEF DESCRIPTION OF THE DRAWINGS

FIG. 7 is a diagram illustrating a classification of eyelash states before application of mascara;

FIG. 8 is a diagram illustrating the mascara selecting process;

FIGS. 11A and 11B are diagrams illustrating a specific measuring method for measuring the eyelash state in the mascara selecting method;

DESCRIPTION OF THE PREFERRED EMBODIMENTS

In the following, preferred embodiments of the present invention are described with reference to the accompanying drawings.

Figure 1:
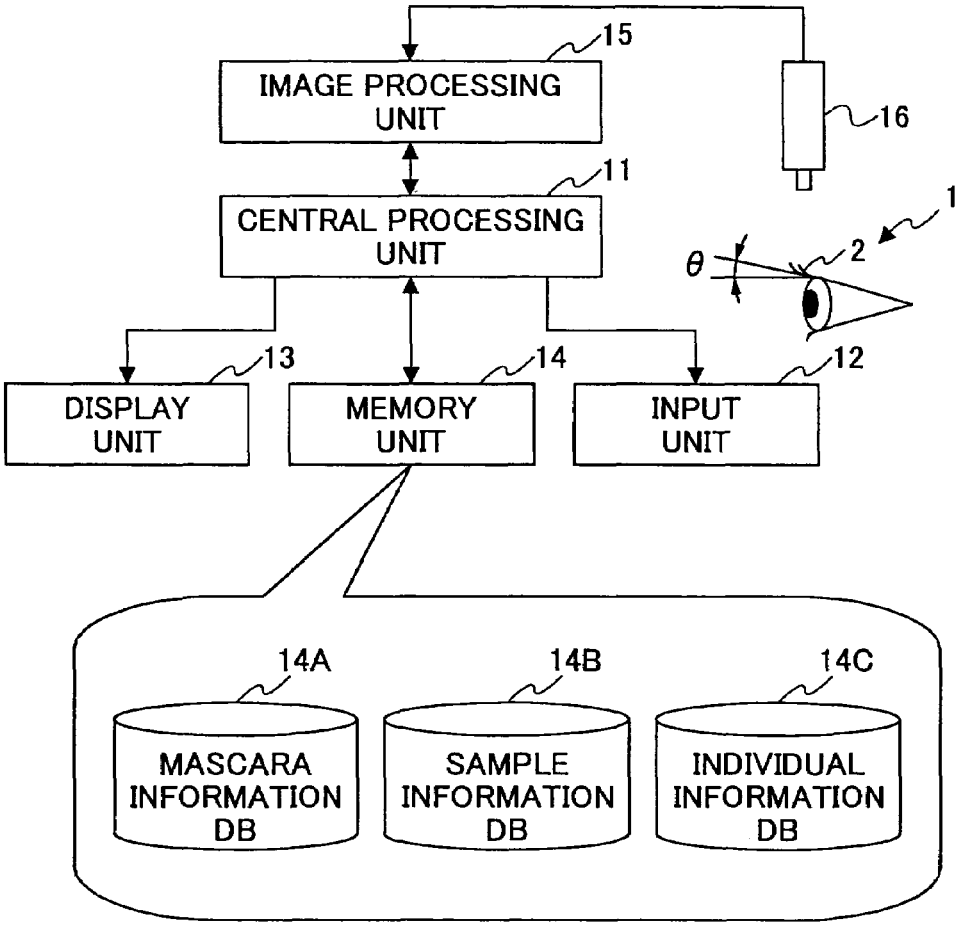
FIG. 1 is a diagram showing a configuration of a mascara selecting system according to a first embodiment of the present invention.

FIG. 1 shows a hardware configuration of a mascara selecting system according to an embodiment of the present invention (referred to as the first embodiment hereinafter). This mascara selecting system can be stationed at a cosmetics selling corner of a department store, for example, and is used for selling a mascara to a customer 1.

As shown in the drawing, the mascara selecting system includes a central processing unit 11, an input unit 12, a display unit 13, a memory unit 14, an image processing unit 15, a camera 16. The memory unit 14 stores various processing programs which will be described later, and the central processing unit 11 executes the above processing programs so as to perform the various processes required for the selection of a mascara. The central processing unit 11 also supervises the input unit 12, the display unit 13, the memory unit 14, the image processing unit 15, and the camera 16, of the system.

The input unit 12 may be a keyboard, for example, which is used to perform an input process of various data required for the selection process. The display unit 13 may be a CRT, for example, which displays, for example, the mascara selection result obtained by performing the selection process, and an image of the eyelashes 2 of the customer 1 taken by the camera 16.

The memory unit 14 stores the above mentioned various processing programs as well as a mascara information database 14A for storing mascara data, which will be described later, a sample information database 14*b* for storing sample information, and an individual information database 14*c* for storing individual information. In the following descriptions, the word 'database' is abbreviated as 'DB'.

The camera 16 is configured to image an eyelash state of the customer 1. The image of the eyelash state of the customer 1 taken by the camera 16 is processed at the image processing unit 15. Specifically, the image of the eyelashes 2 obtained by the camera 16 is processed into a binarized picture at the image processing unit 15. Also, although not shown in FIG. 1, the system may include an output means for a printer to print out the selection result.

Next, a mascara selecting process of the mascara selecting system having the above described system configuration will be described.

Figure 2:
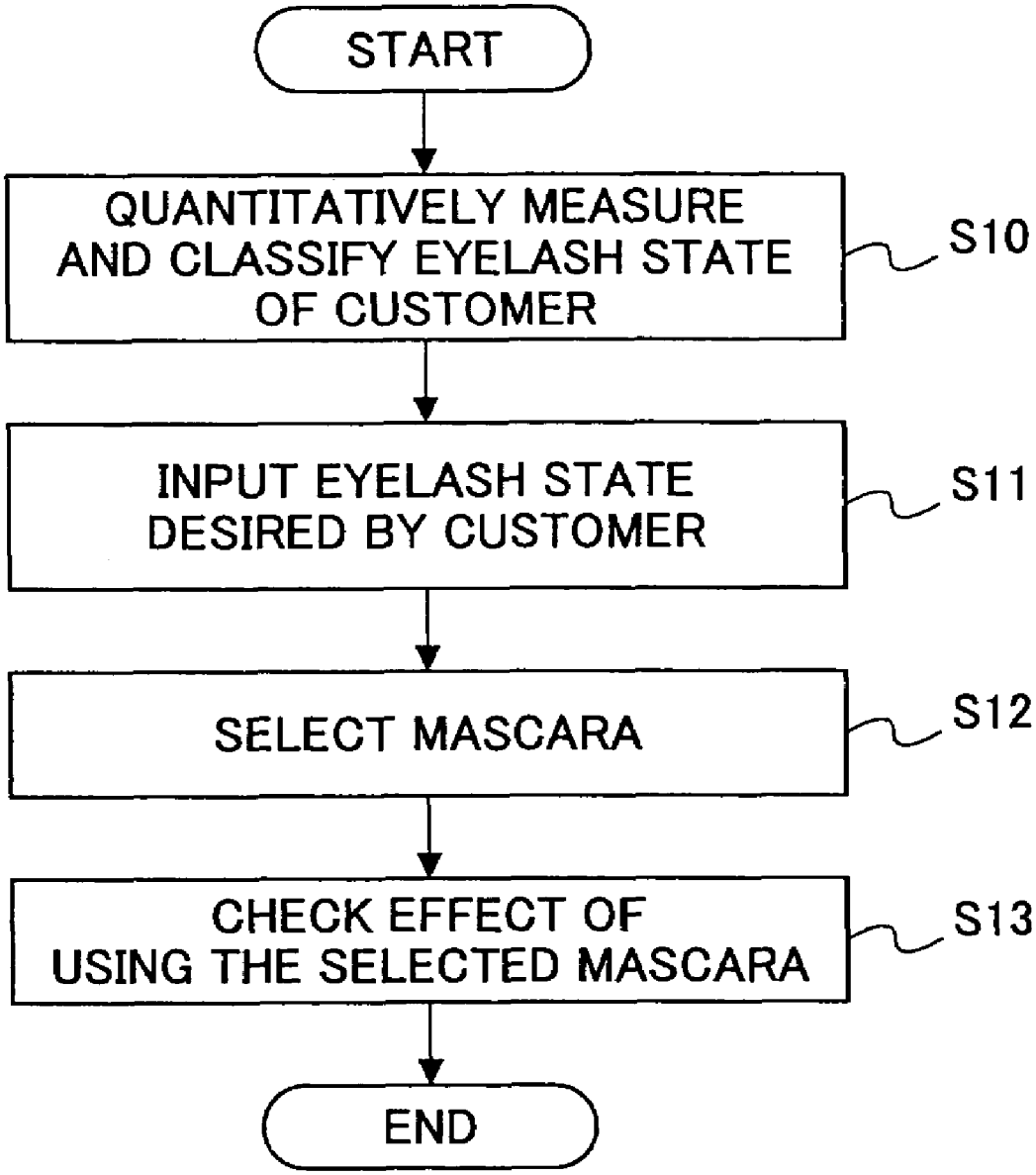
FIG. 2 is a flowchart showing a mascara selecting process implementing the mascara selecting method according to the first embodiment of the present invention.

When the mascara selecting system is activated, the central processing unit 11 executes a main program, stored in the memory unit 14, that performs the mascara selecting process. FIG. 2 is a flowchart illustrating the main program that performs the mascara selecting process. When the main program shown in this drawing is activated, first of all, in step 10 (the word 'step' is abbreviated as 'S' in the drawing), a process of measuring an eyelash state before application of mascara and a process of classifying the eyelashes 2 of the customer 1 based on the measurement result are performed (first measurement step).

Figure 3:
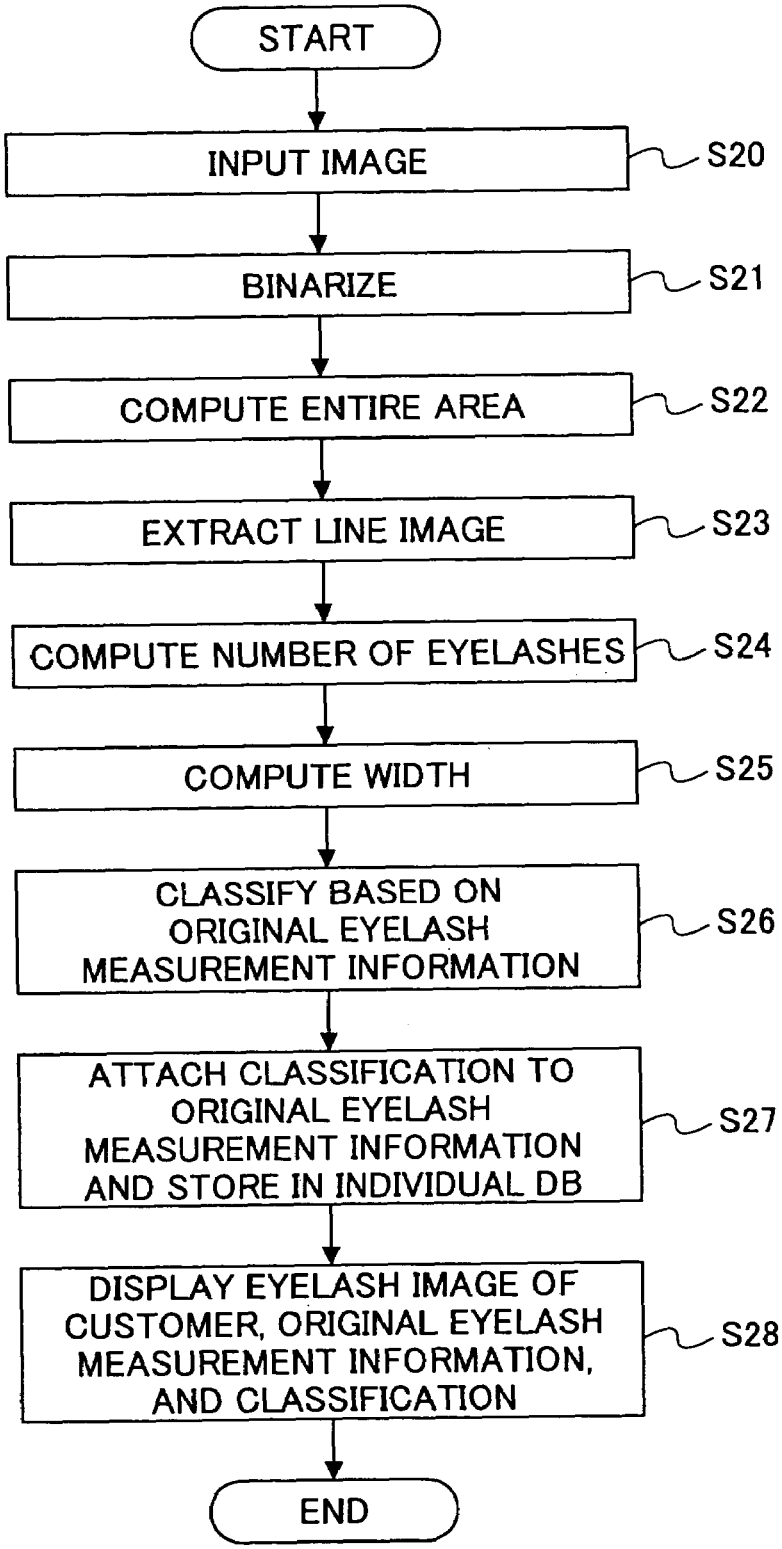
FIG. 3 is a flowchart showing a measuring process of measuring an eyelash state before application of mascara.

FIG. 3 shows the specific processes of the quantitative measurement of the eyelash state performed in step 10.

The quantitative measurement processes of the eyelash state shown in FIG. 3 are stored in the memory unit 14 as subprograms that are called and executed upon performing the process of step 10.

When the quantitative measurement of the eyelash state shown in FIG. 3 is initiated, first of all, in step 20, a process of inputting the image of the eyelashes 2 of the customer 1 is performed. In this image inputting process, the central processing unit 11 activates the camera 16 and images the eyelashes 2 of the customer 1. In this case, the camera 16 obtains an overall planar view image of the eyelashes 2. Also, although not included in the measurement conditions of the first embodiment, the curl angle of the eyelashes 2 (angle indicated by arrows θ in FIG. 1) may be measured. In this case, the side view of the eyelashes 2 is also obtained.

Figure 9:
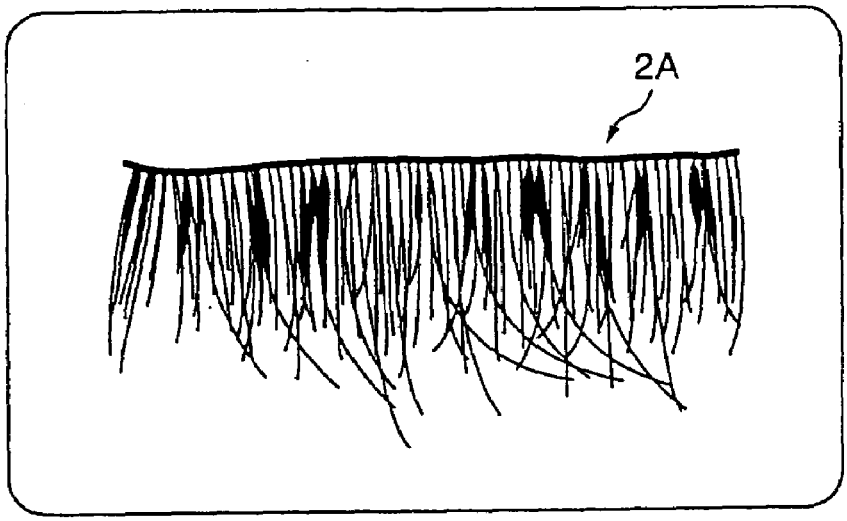
FIG. 9 is a diagram illustrating exemplary eyelashes before application of the mascara.

Next, in step 21, the image obtained by the camera 16 is sent to the image processing unit 15 where image processing is performed. Specifically, the image of the eyelashes 2 taken by the camera 16 is binarized and, if necessary, a smoothing process or a noise filtering process may also be performed. FIG. 9 shows a binarized image of the eyelashes 2 (binary image).

When the process of step 21 is completed and the binary image of the eyelashes 2 is generated, a process of computing the entire area of the eyelashes is performed in step 22. This process of computing the entire area is realized by obtaining the number of black pixels in the binary image of the eyelashes 2, and multiplying the number of black pixels by the area represented by one pixel.

After the entire area of the eyelashes 2 is computed in step 22, a process of extracting a line image from the binary image of the eyelashes 2 is performed in step 23. FIGS. 11A and 11B are diagrams illustrating the line image extraction process.

As is shown in FIG. 11A, in the first embodiment, a linear image region extending in a direction perpendicular with respect to the extending direction of the eyelashes 2 is extracted from the binary image of the eyelashes 2. FIG. 11B shows the extracted linear image. The linear image shown in this drawing is an extraction of the eyelashes 2 in the range of 107 to 115 pixels away from the root of the eyelashes 2.

When the above-described extraction process of the linear image is completed, the number of eyelashes 2 is computed by analyzing this linear image in step 24. For example, the number of eyelashes 2 is obtained by tracing the linear image shown in FIG. 11B in the direction indicated by the arrow X in the drawing and counting the positions at which the pixels change from white to black.

Next, in step 25, the thickness of the eyelashes 2 (i.e. the average width of one eyelash strand) is computed also through analyzing the linear image extracted in step 23. Specifically, the number of black pixels in the linear image shown in FIG. 11B is counted and this number is multiplied by the area of one pixel to obtain the area of the eyelashes 2 in the linear image.

Next, the obtained area is divided by the number of eyelashes 2 obtained in step 24. In this way, the average area of one eyelash strand 2 can be obtained. As alluded to above, in the first embodiment, the thickness of the linear image is 8 pixels (115 pixels−107 pixels=8 pixels). Thus, the average area of one strand of the eyelash 2 obtained in the manner described above is divided by 8 pixels. In this way, the average width (thickness) of one eyelash strand 2 can be obtained. Herein, a unit conversion process may be performed if necessary so that the measurements will be in millimeters.

In the following description, information indicating the eyelash state of the customer 1 including the entire area of the eyelashes 2 obtained in step 22, the number of eyelashes 2 obtained in step 24, and the average width of one strand of eyelash 2 obtained in step 25 is referred to as the original eyelash measurement information.

After the original eyelash measurement information is obtained in steps 20–25 as described above, a process of classifying the eyelashes 2 of the customer 1 based on the original eyelash measurement information is performed in step 26. This classification process is performed using a map such as that shown in FIG. 7, which standardizes and systemizes the information included in the original eyelash measurement information. The map is a list including a plurality of classification conditions ('condition'), such as the entire area, and the number of eyelashes, which make up the classification system.

Specifically, the entire area of the eyelashes 2 obtained in step 22 is classified based on a predetermined value S, and if the entire area of the eyelashes 2 of the customer 1 is below the area S, the eyelashes 2 are classified as 'thin'. On the other hand, if the entire area of the eyelashes 2 of the customer 1 is above or equal to the area S, the eyelashes 2 are classified as 'thick'.

Similarly, the number of eyelashes 2 obtained in step 24 is classified as 'few' if this number is below a number N, and 'many' if the number of eyelashes 2 of the customer 1 is above or equal to the number N. In this way, the classification process with respect to each condition is performed on the original eyelash measurement information.

It id noted that in the example shown in FIG. 7, the classification is performed by merely setting one threshold value for each condition and determining whether the subjected value is greater or less than the threshold value. However, the classification method is not limited to the above described method, and the classification may be more detailed.

After the above classification process of the eyelashes 2 is completed, in step 27, the classification information obtained in step 26 is attached to the original eyelash measurement information, and this is stored in the individual information DB 14C of the memory unit 14. Also, in step 28, the image of the eyelashes 2 of the customer 1, the original eyelash measurement information, and the classification information are displayed on the display unit 13. By performing the above described processes, the processes of step 10 shown in FIG. 2 are completed.

According to the first embodiment, in step 10, a measurement apparatus for processing the input image obtained by the camera 16 is used. However, the present invention is not limited to this measurement method, and instead, an experienced person may measure the eyelash state based on his/her visual perception.

Figure 4:
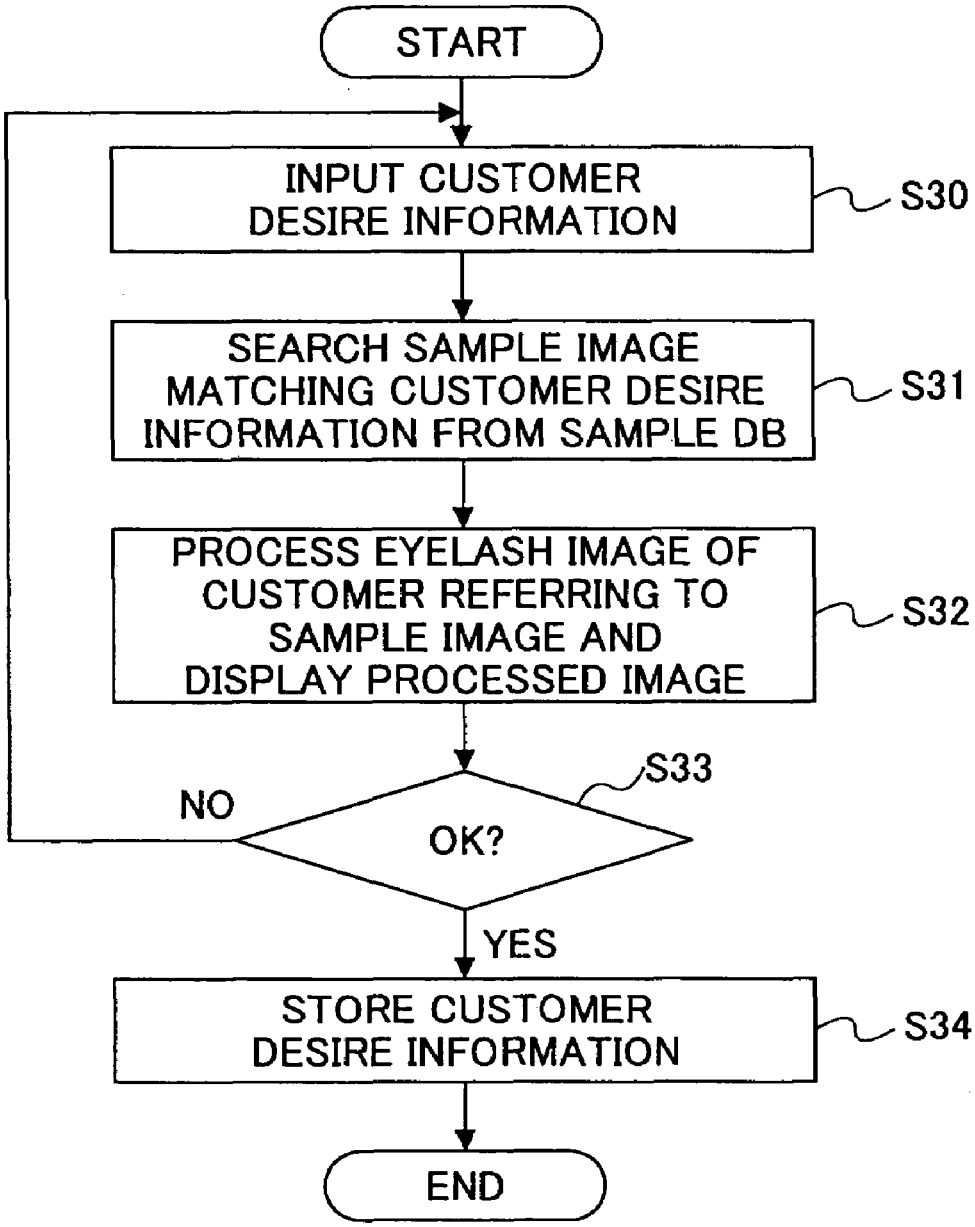
FIG. 4 is a flowchart showing an input process of inputting customer desire information.

After the completion of the processes of step 10, next, in step 11, an input process of inputting an eyelash state desired by the customer 1 is performed (ascertaining step). FIG. 4 shows the specific input processes performed in step 11. The desired eyelash input processes shown in FIG. 4 are stored in the memory unit 14 as subprograms that are called and executed upon performing the process of step 11.

When the desired eyelash input process shown in FIG. 4 is started, first, in step 30, a process of inputting customer desire information is performed. Herein, the customer desire information refers to information on the eyelash state desired by the customer 1 (e.g., 'a natural look') obtained beforehand by interviewing the customer 1.

After the customer desire information is input in step 30, the central processing unit 11 searches a sample image corresponding to the customer desire information from the sample information DB 14B. In the sample information DB 14B, conceptual images of eyelashes corresponding to various conditions expected to be input as customer desire information (e.g., 'a natural look', 'volume', 'cute') are stored. Thus, in step 31, the conceptual image that will be a best match with respect to the customer desire information of the customer 1 is searched from the sample information DB 14B based on the customer desire information of the customer 1 input in step 30.

Next, in step 32, the image of the eyelashes 2 of the customer 1 taken by the process of step 20 shown in FIG. 3 is processed based on the sample image searched out in step 31. Specifically, a synthesizing process is performed on the image of the eyelashes 2 of the customer 1 and the sample image searched out in step 31, and the resulting image is displayed on the display unit 13. In this way, the customer 1 can look at the image displayed on the display unit 13 and visually determine whether the displayed eyelash state corresponds to the eyelash state that the customer 1 actually wants.

In other words, the customer desire information input in step 30 is based only on the imagination of the customer 1. Thus, this information does not necessarily represent an objective preference of the customer 1. However, by performing the process of step 32, the image displayed on the display unit 13 can be reviewed by the customer 1, and the desired eyelash state of the customer 1 can be objectively evaluated.

Next, in step 33, an input is made as to whether or not the image displayed on the display unit 13 corresponds to what the customer 1 actually wants. If the displayed image is not what the customer 1 actually wants (if NO), the process goes back to step 30 and the above described processes of steps 30–33 are repeated. The processes of steps 30–33 are performed until the displayed image matches what the customer 1 wants.

Then, in step 33, when the customer 1 determines the displayed image to be what the customer 1 actually wants, the process moves on to step 34, where the customer desire information, objectively determined by the customer 1 to be the desired eyelash state of the customer 1, and, if necessary, the conceptual image corresponding to the desire information of the customer 1, for example, are stored in the memory unit 14. By performing the above described processes, the processes of step 11 shown in FIG. 2 will be completed.

Figure 5:
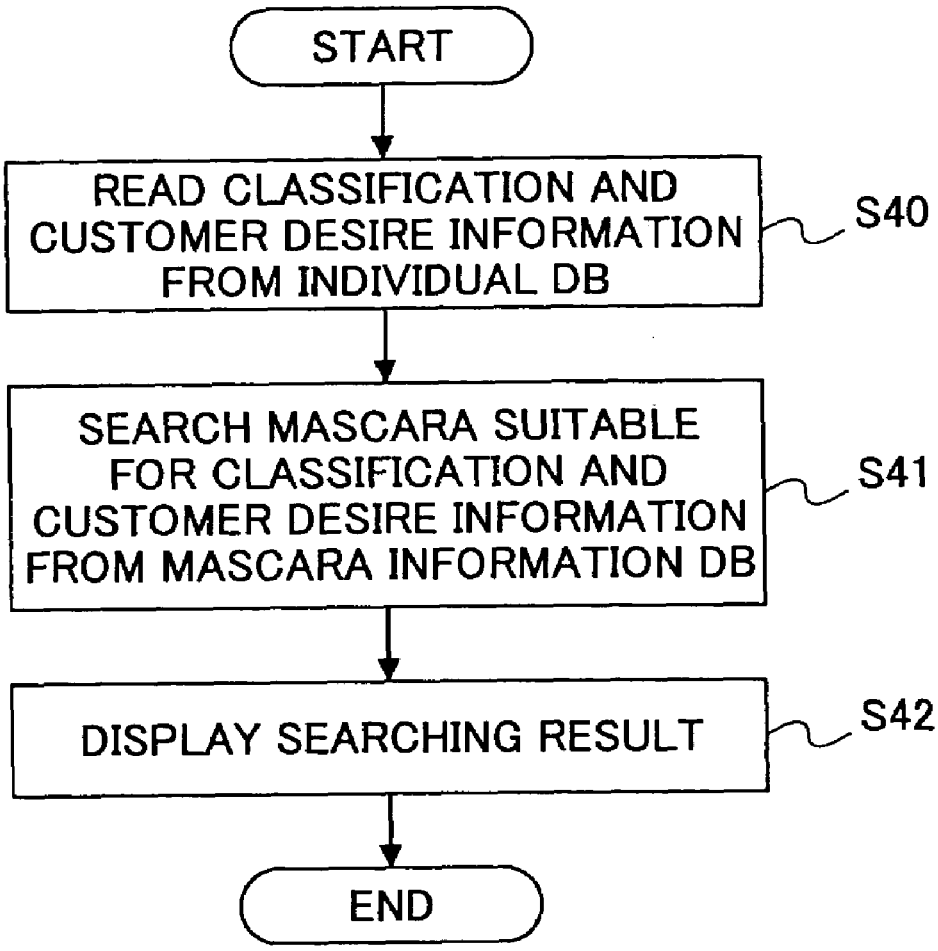
FIG. 5 is a flowchart showing a mascara selecting process.

When the process of step 11 is completed, next, in step 12, a process of selecting a mascara that corresponds to the customer desire information is performed (selection step) FIG. 5 shows the specific processes of the mascara selection process performed in step 12. The mascara selection processes shown in FIG. 5 are also stored in the memory unit 14 as subprograms that are called and executed upon performing the process of step 12.

When the mascara selection process shown in FIG. 5 is started, first, in step 40, the original eyelash measurement information of the eyelashes 2 of the customer 1, with the classification information attached, stored by the process of step 27 (see FIG. 3) is read out from the individual information DB 14C and the customer desire information of the customer 1 stored by the process of step 34 (see FIG. 4) are read out from the memory unit 14.

Next, in step 41, a suitable mascara is searched from the mascara information DB 14A based on the original eyelash measurement information and the customer desire information read out by the process of step 40. As is shown in FIG. 8, the mascara information DB 14A stores a map that indicates the relationship between the classification results of FIG. 7, the different types of mascara, and the eyelash states after application of mascara. As is shown in this map, for example, if 'mascara A' is applied to eyelashes classified as 'thin', it can be determined that the eyelash state after application of the 'mascara A' will be a 'natural' look.

In step 41, first, the central processing unit 11 specifies a classification (classification result) in the map of FIG. 8 according to the classification information attached to the original eyelash measurement information read out by the process of step 40. Then, the central processing unit 11 searches a mascara-applied eyelash state that matches or is similar to the customer desire information, and identifies the mascara corresponding to this searched out mascara-applied eyelash state.

For example, if the eyelashes 2 of the customer 1 are classified as 'thin' according to the classification information attached to the original eyelash measurement information and the customer desire information is 'toned down', the central processing unit 11 specifies the classification as 'thin' in the classification column of the map shown in FIG. 8. Next, the central processing unit 11 searches the mascara-applied eyelash state column in the map shown in FIG. 8 to see if a state 'toned down' exists in this column.

Since the state 'toned down' does exist in the mascara-applied eyelash state column of the map of FIG. 8, the central processing unit 11 selects the mascara corresponding to the state 'toned down' from the mascara column. Thus, in the above example, the central processing unit 11 selects 'mascara C'. The mascara selected according to the above described procedures will be a mascara that is suitable for the eyelash state of the customer 1 and also in accordance with the customer desire information of the customer 1.

When a mascara suitable for the eyelash state of the customer 1 and in accordance with the customer desire information of the customer 1 is determined by the processes of steps 40 and 41 as described above, the central processing unit 11 displays the search results on the display unit 13. By performing the above processes, the process of step 12 shown in FIG. 2 will be completed.

Figure 6:
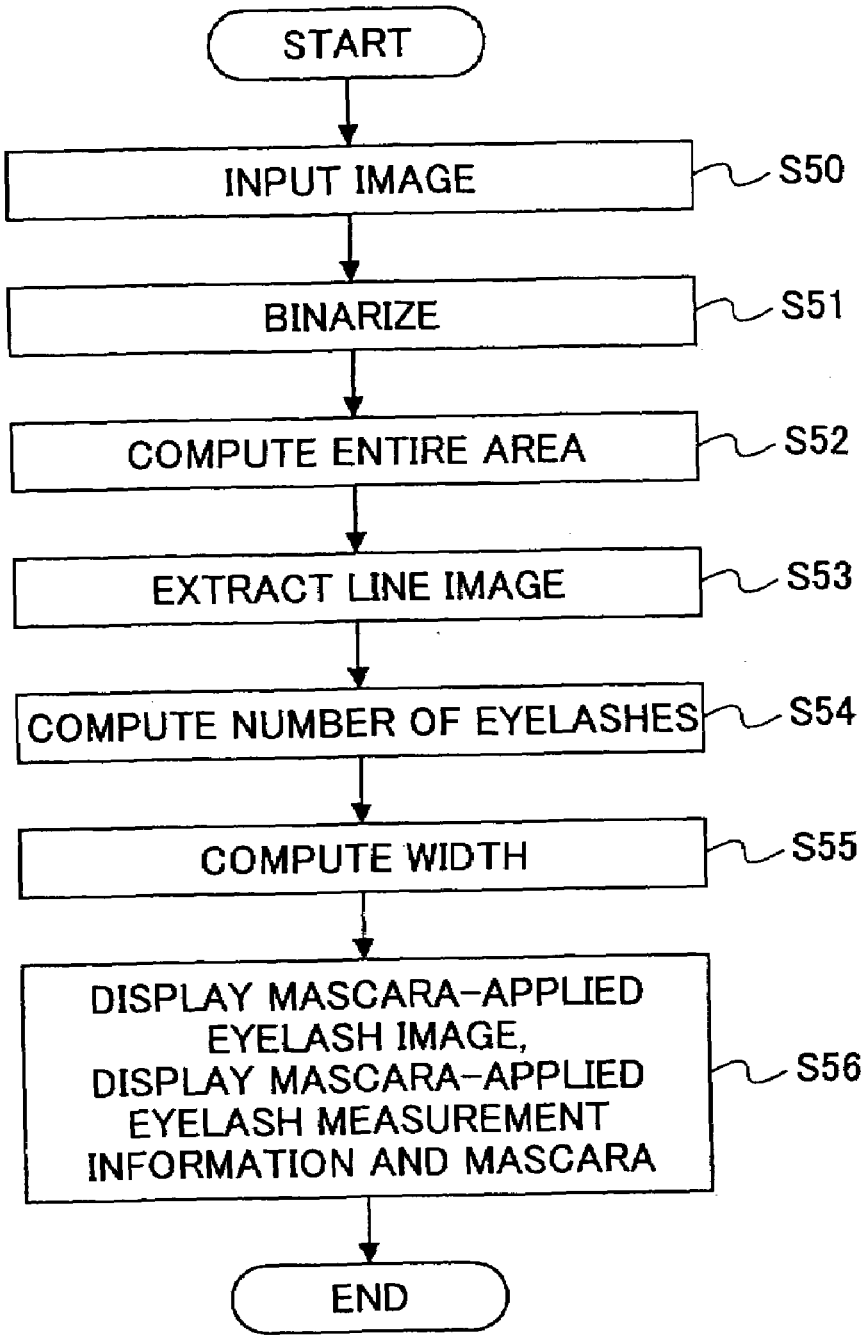
FIG. 6 is a flowchart showing a measuring process of measuring a state of eyelashes after application of mascara.

After the process of step 12 is completed, next, in step 13, the selected mascara is actually used by the customer 1 (applied), and a process of checking the results from using the mascara is performed (second measurement step). FIG. 6 shows the specific processes of step 13 in which the results from using the selected mascara are checked. The processes shown in FIG. 6 are also stored in the memory unit 14 as subprograms that are called and executed upon performing the process of step 13.

Figure 10:
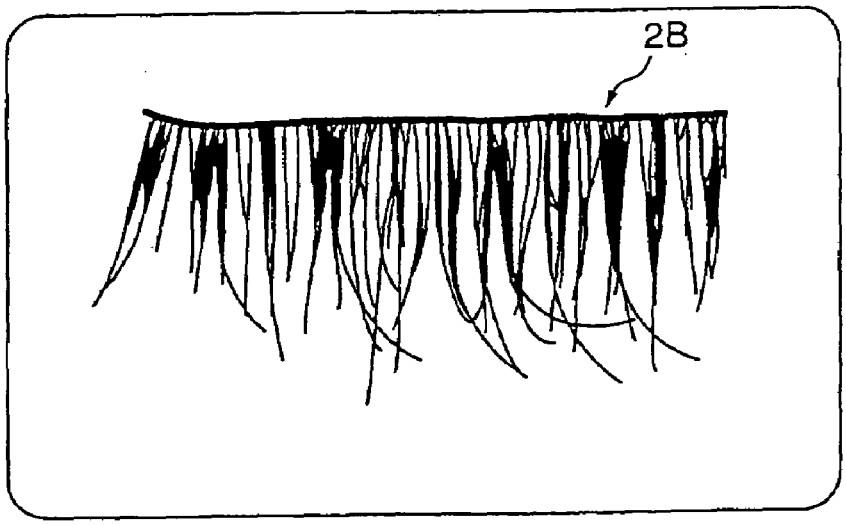
FIG. 10 is a diagram illustrating exemplary eyelashes after application of the mascara.

Before the processes shown in FIG. 6 are started, the mascara selected in step 12 beforehand is applied to the eyelashes 2 of the customer 1. FIG. 10 is a diagram showing an example of the state of eyelashes 2 after application of the mascara. After the mascara is applied to the eyelashes 2 of the customer 1, a quantitative measurement of the eyelashes 2 is performed.

The quantitative measurement of the mascara-applied eyelashes 2 shown in FIG. 6 is performed in a manner identical to the quantitative measurement of the eyelashes 2 without the mascara applied that is performed in step 10. That is, the processes of steps 50–55 shown in FIG. 6 are identical to the processes of steps 20–25 shown in FIG. 3. Thus, the description of steps 50–55 will be omitted.

In step 56, the image of the eyelashes 2 of the customer 1 obtained in step 50 is displayed on the display unit 13. Also, the entire area of the eyelashes 2 obtained instep 52, the number of the mascara-applied eyelashes 2 obtained in step 54, and the average width of one strand of the mascara-applied eyelashes 2 obtained in step 55 are also displayed on the display unit 13 along with the image of the eyelashes 2. By performing the above described processes, the process of step 13 shown in FIG. 2 will be completed.

According to the above-described first embodiment, the state of the eyelashes 2 of the customer 1 is quantitatively measured, and a mascara is selected based on the measurement results from the above. Also, since the state of eyelashes desired by the customer 1 (customer desire information) can be determined with reference to the image displayed on the display unit 13, the customer desire information will be an objective preference of the customer 1.

By selecting a mascara based on the objective measurement results of the eyelashes 2 and the objective customer desire information, a mascara that is suitable for the eyelash state of the customer 1 and capable of realizing an eyelash state desired by the customer 1 can be accurately selected. Further, in the first embodiment, the selected mascara is applied to the eyelashes 2 of the customer 1, and the mascara-applied eyelash state of the customer 1 is quantitatively measured. Thus, it can be objectively determined whether the selected mascara can actually realize the eyelash state desired by the customer 1.

Additionally, in the first embodiment, the eyelash state of the customer 1 before application of mascara is classified according to a pre-established classification, and in the mascara information DB 14A, information on the relationship between an eyelash state before application of mascara (classification) and an eyelash state after application of the mascara (mascara-applied eyelash state) for each mascara is stored as mascara information. In this way, a mascara that can satisfy the desire of the customer 1 can be easily and quickly selected in the mascara selecting process of step 12.

Next, a modification of the first embodiment will be described.

Figure 12:
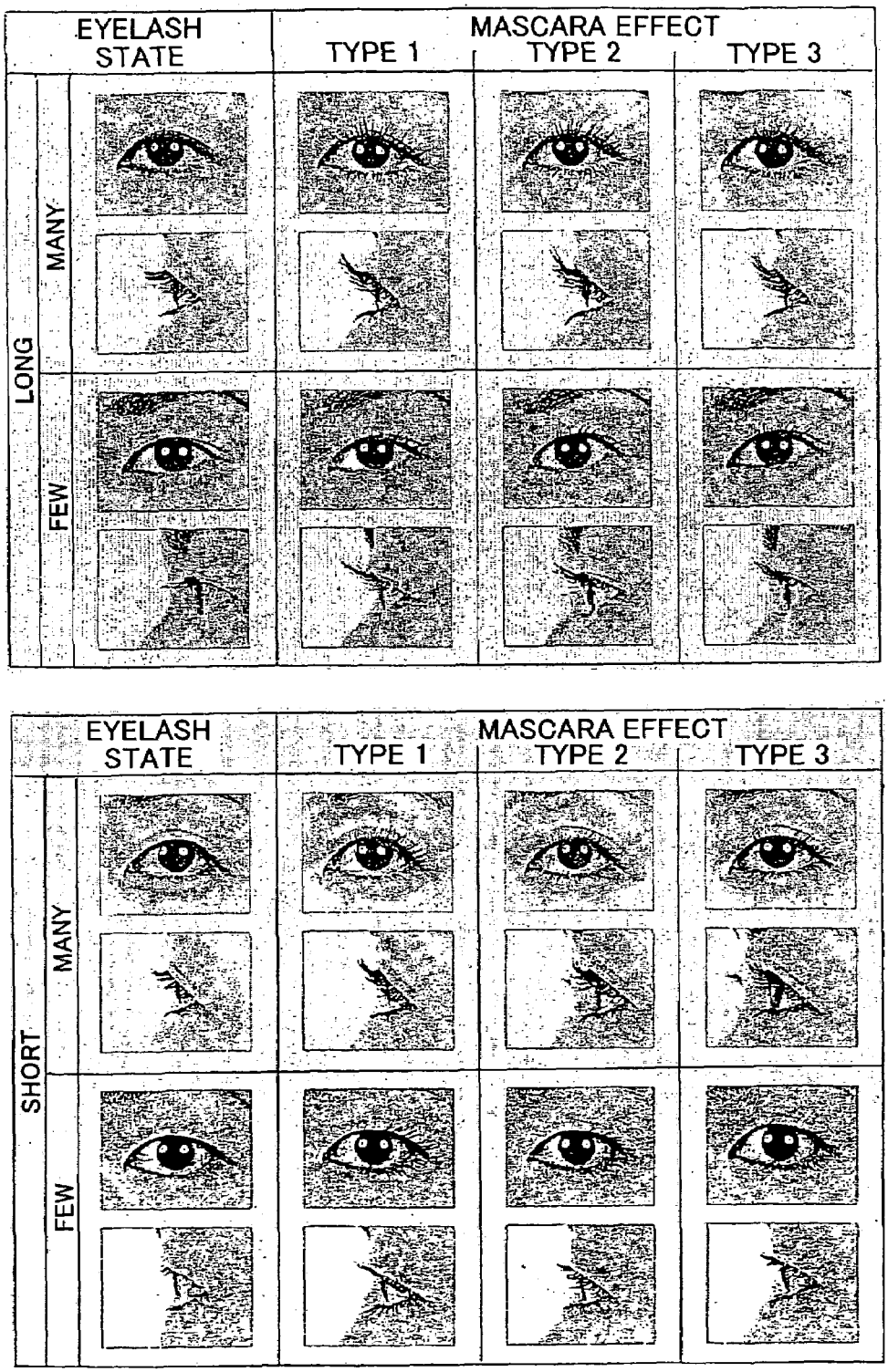
FIG. 12 shows a mascara counseling sheet mapping out a plurality of original eyelash states and a plurality of corresponding mascara-applied eyelash states each representing results of applying a predetermined mascara to each of the original eyelash states.

In the modification, a mascara counseling sheet shown in FIG. 12 is used as a mascara counseling tool. The mascara counseling sheet maps out a plurality of original eyelash states and a plurality of corresponding mascara-applied eyelash states, each with a predetermined mascara applied, for each of the original mascara states. It is noted that the mascara counseling tool may alternatively be printed in a magazine or may take the form of a storefront display.

The original eyelash state is classified depending on whether the eyelashes are 'long' or 'short' and whether there are 'many' or 'few'. As for the mascara (mascara effect), three types of mascaras having differing effects upon being applied under suitable conditions, namely, a mascara that has an effect of enhancing the length of eyelashes (type 1), a mascara that has an effect of enhancing the volume of eyelashes (type 2), and a mascara that has an effect of retaining the curl of eyelashes (type 3), are selected.

Then, front view pictures and side view pictures of each of the above original eyelash states and the corresponding mascara-applied eyelash states, each with one of the three types of mascaras applied, are shown.

In this modified embodiment, the mascara selecting method may involve measuring the eyelash state of the customer 1 by using procedures identical to the first embodiment (first measurement step), and then showing the mascara counseling sheet to the customer 1 to show where the eyelash state of the customer 1 is positioned in the map. From among the pictures of eyelash states with mascaras of type 1–3 applied, corresponding to the eyelash state of the customer, the customer 1 chooses a picture showing the desired mascara effect (ascertaining step and selecting means). In this way, a mascara that is desired by the customer 1 can be selected. Further, if necessary, the same procedure of the first embodiment may be used to measure the eyelash state of the customer 1 after application of the selected mascara (second measurement step).

According to the modified embodiment, the ascertaining step and the selecting means are simplified.

Next, the present invention according to another embodiment (referred to as 'second embodiment', hereinafter) will be described.

In the second embodiment, a mascara that will be suitable for each eyelash state (original eyelash state) is evaluated and established beforehand in selecting a mascara.

The inventor of the present invention has classified eyelash states (original eyelash states) depending on whether the eyelashes are 'long' or 'short' and whether there are 'many' or 'few'. As for the mascara (mascara effect), three types of mascaras having differing effects upon being applied under suitable conditions, namely, a mascara that has an effect of enhancing the length of eyelashes (type A), a mascara that has an effect of retaining the curl of eyelashes (type B), and a mascara that has an effect of enhancing the volume of eyelashes (type C), are selected.

Then, the curl angle (unit: degrees) of the eyelashes of each original eyelash state and the corresponding mascara-applied eyelash states with the three types of mascara applied are measured. The curl angle is the angle formed between a horizontal line and a tangent line extending from the root of the eyelashes when the eye is positioned horizontally (see FIG. 1). It is noted that the maximum value of the curl angle of the eyelashes is used as the curl angle. It has been found that the greater the curl angle, the more natural and bigger the eyes look.

Figure 13:
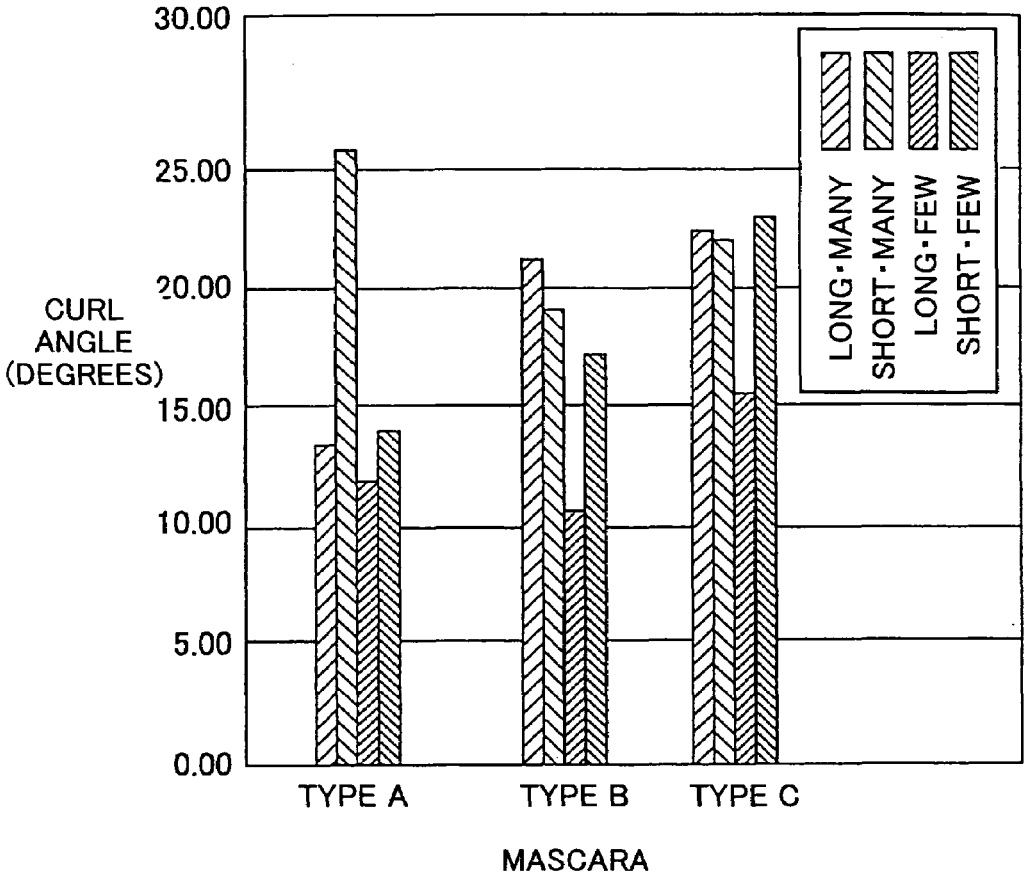
FIG. 13 is a graph showing the measurement results of curl angles.

Based on the curl angle measurement results shown in FIG. 13, the mascara that has the effect of making eyelashes look longer (type A) realizes a maximum curl angle for an eyelash state with many short lashes, the mascara that has the effect of retaining the curl of eyelashes (type B) realizes a maximum curl angle for an eyelash state with many long lashes, and the mascara that has the effect of enhancing the volume of eyelashes (type C) realizes a maximum curl angle for an eyelash state with few long lashes.

Figure 14:
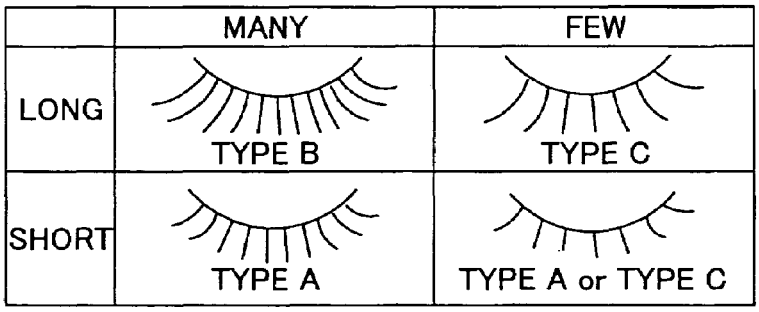
FIG. 14 is a mascara map for different eyelash types indicating a suitable mascara that can realize optimal eyelash states for each eyelash type.

From the above curl angle information, a mascara map for different eyelash types shown in FIG. 14 can be obtained. The mascara map for the different eyelash types is a diagram indicating the mascara that can realize optimal eyelash states for each of the original eyelash states. In FIG. 14, four regions divided (classified) based on whether the eyelashes are 'long' or 'short' and whether there are 'many' or 'few' each show a drawing of the respective eyelash state (original eyelash state) so that the eyelash states can be instantly recognized. Also, in each of the divided regions, the mascara type that can maximize the curl angle for the relevant eyelash state (original eyelash state) is indicated (in this example, mascara types A–C are shown). Further, it is preferable that a description of an eyelash state that can be expected from applying the mascara is given in words or in some other form (not shown).

In the mascara selecting method of the second embodiment, the procedures identical to those of the first embodiment may be used in the first measurement step for measuring the eyelash state of the customer, or preferably, the eyelash state may be measured by an experienced person based on his/her visual perception. Then, in the selection step of selecting a mascara, the above described mascara map for the different types of eyelashes is used to select a mascara suitable for the eyelash state of the customer 1. In this way, a mascara that is suitable for the eyelash state of the customer and capable of realizing an eyelash state that can satisfy the customer can be selected with ease.

What is claimed is:

1. A mascara selecting system for selecting a mascara that can realize an eyelash state desired by a customer, comprising:

an imaging apparatus configured to image both eyelashes without the mascara applied and eyelashes with the mascara applied;

measuring means for quantitatively measuring the eyelash state of the imaged eyelashes based on the image obtained from the imaging apparatus;

a database for storing mascara information indicating a relationship between the eyelash state before application of the mascara and the eyelash state after the application of the mascara for each mascara;

an input apparatus for inputting an eyelash state desired by the customer;

searching means for searching a mascara that meets the desire of the customer from the database based on the eyelash state of the customer before application of the mascara obtained by the measuring means and the eyelash state desired by the customer input from the input apparatus; and display means for displaying at least the image of the eyelashes of the customer obtained by the imaging apparatus and the mascara searched out by the searching means.

2. The mascara selecting system as claimed in claim 1, further comprising:

classifying means for classifying the eyelash state of the customer before application of the mascara measured by the measuring means according to a predetermined system; wherein the mascara information stored in the database is arranged to include information on a relationship between a mascara and the eyelash state obtained from applying said mascara for each classification result.

3. A mascara selecting method comprising:

a first measurement step of measuring an eyelash state of a customer; and a selection step of selecting a mascara based on the measurement results obtained from the first measurement step wherein an apparatus inputs an eyelash state desired by the customer and a searching means searches for a mascara that meets the desire of the customer from the database based on the eyelash state of the customer before application of the mascara obtained by the measuring and the eyelash state desired by the customer input from the apparatus; wherein; wherein the mascara selected in the selection step is applied to the eyelashes of the customer, after which a second measurement step is performed whereby a measuring apparatus is used to measure the eyelash state of the customer wearing the mascara; and the eyelashes are imaged using an imaging apparatus and the eyelash state is measured based on the obtained image when measuring the eyelash state in the first measurement step and the second measurement step.

4. The mascara selecting method as claimed in claim 3, further comprising:

an ascertaining step of ascertaining a desire of the customer with respect to eyelashes, performed between the first measurement step and the selection step; wherein a mascara is selected in the selection step based on the measurement results obtained by the first measurement step and the desire of the customer obtained by the ascertaining step.

5. The mascara selecting method as claimed in claim 4, wherein:

the eyelash state of the customer is measured using a measuring apparatus in the first measurement step.

* * * * *